US006443821B1

(12) United States Patent
Kimura et al.

(10) Patent No.: US 6,443,821 B1
(45) Date of Patent: Sep. 3, 2002

(54) WORKPIECE CARRIER AND POLISHING APPARATUS HAVING WORKPIECE CARRIER

(75) Inventors: Norio Kimura; Hozumi Yasuda, both of Fujisawa (JP)

(73) Assignee: Ebara Corporation, Tokyo (JP)

( * ) Notice: Subject to any disclaimer, the term of this patent is extended or adjusted under 35 U.S.C. 154(b) by 11 days.

(21) Appl. No.: 09/712,155

(22) Filed: Nov. 15, 2000

(30) Foreign Application Priority Data

Nov. 16, 1999 (JP) ..... 11-325792

(51) Int. Cl.[7] ..... B24B 1/00

(52) U.S. Cl. ..... 451/286; 451/285; 451/288; 451/398; 451/41

(58) Field of Search ..... 451/41, 285, 287, 451/288, 385, 397, 398, 286

(56) References Cited

U.S. PATENT DOCUMENTS 5,662,518 A * 9/1997 James et al. ..... 451/384
5,733,182 A * 3/1998 Muramatsu et al. ..... 451/289
5,762,539 A * 6/1998 Nakashiba et al. ..... 451/41
6,024,630 A * 2/2000 Shendon et al. ..... 451/41
6,050,882 A 4/2000 Chen

* cited by examiner

*Primary Examiner*—George Nguyen
(74) *Attorney, Agent, or Firm*—Wenderoth, Lind & Ponack, L.L.P.

(57) ABSTRACT

A workpiece carrier holds a workpiece such as a semiconductor wafer and presses the workpiece against a polishing surface on a polishing table. The workpiece carrier has a top ring body for holding the workpiece, and a retainer ring for holding an outer circumferential edge of the workpiece. A fluid chamber which is supplied with a pressurized fluid such as a compressed air is provided in the top ring body and covered by a resilient membrane. A plurality of pressing members are fixed to the resilient membrane for applying a pressing force through the resilient membrane to the workpiece under the pressure of the fluid in the fluid chamber.

18 Claims, 7 Drawing Sheets

101
102
103
104
105
106
1
2
4
5
5A
6
8
12
W

WORKPIECE CARRIER AND POLISHING APPARATUS HAVING WORKPIECE CARRIER

BACKGROUND OF THE INVENTION

1. Field of the Invention

The present invention relates to a workpiece carrier for holding a workpiece such as a semiconductor wafer while the workpiece is being polished to make a surface of the workpiece exhibit a flat mirror finish, and a polishing apparatus having such a workpiece carrier.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable having a polishing cloth attached thereon, and a top ring for applying a constant pressure against the turntable. A semiconductor wafer to be polished is placed on the polishing cloth and clamped between the top ring and the turntable, and the surface of the semiconductor wafer on which circuits are formed is chemically and mechanically polished, while supplying a polishing liquid onto the polishing cloth. This process is called chemical mechanical polishing (CMP).

The polishing apparatus is required to have such performance that the surfaces of semiconductor wafers have a highly accurate flatness. Therefore, it is considered that the holding surface, i.e. the lower end surface of the top ring which holds a semiconductor wafer, and the upper surface of the polishing cloth which is held in contact with the semiconductor wafer, and hence the surface of the turntable to which the polishing cloth is attached, preferably have a highly accurate flatness, and the holding surface and the surface of the turntable which are highly accurately flat have been used. It is also considered that the lower surface of the top ring and the upper surface of the turntable are preferably parallel to each other, and such parallel surfaces have been used.

The semiconductor wafers to be polished, with circuits formed thereon, do not have a uniform thickness over their entire surfaces. There has been an attempt to attach an elastic pad made of polyurethane or the like to the holding surface of the top ring for holding a semiconductor wafer for thereby uniformizing a pressing force applied from the top ring to the semiconductor wafer to be polished, over the entire surface of the semiconductor wafer. When the pressing force applied to the semiconductor wafer is uniformized by the elastic pad, the semiconductor wafer is prevented from being polished in a localized region for thereby improving flatness of the polished surface of the semiconductor wafer.

However, the method for uniformizing the pressing force applied to the semiconductor wafer by elasticity of the elastic pad fails to meet stricter requirements for increased flatness of polished semiconductor wafers.

Efforts have also been made to employ a diaphragm made of an elastic material such as rubber as the holding surface of the top ring for holding a semiconductor wafer, and apply a fluid pressure such as an air pressure to the reverse side of the diaphragm to uniformize the pressing force applied to the semiconductor wafer over its entire surface. The top ring with the diaphragm used as its holding surface includes a guide ring or retainer ring disposed at the outer circumferential edge of the diaphragm for holding a semiconductor wafer. The outer circumferential portion of the diaphragm corresponds to the outer circumferential portion of the semiconductor wafer, and the outer circumferential edge of the diaphragm needs to be fixed to the top ring or the guide ring. Therefore, even when a fluid pressure such as an air pressure is applied to the reversed side of the diaphragm, the outer circumferential portion of the diaphragm is elastically deformed to a smaller extent than the outer area of the diaphragm, and hence tends to become a point of inflection. Accordingly, the polishing pressure applied to the outer circumferential portion of the semiconductor wafer is smaller than the polishing pressure applied to the other area of the semiconductor wafer such as the central area thereof, resulting in such a problem that the outer circumferential portion of the semiconductor wafer is polished to a smaller extent than the other area of the semiconductor wafer.

Consequently, the above conventional proposals to use the elastic pad and the diaphragm as the holding surface cannot apply a uniform pressing force to the entire surface of the semiconductor wafer to be polished.

SUMMARY OF THE INVENTION

It is therefore an object of the present invention to provide a workpiece carrier which is capable of applying a uniform pressing force to the entire surface of a workpiece such as a semiconductor wafer for thereby polishing the surface of the workpiece uniformly, and a polishing apparatus which incorporates such a workpiece carrier.

According to an aspect of the present invention, there is provided a workpiece carrier for holding a workpiece to be polishing and pressing the workpiece against a polishing surface on a polishing table, comprising: a top ring body for holding the workpiece; a retainer ring for holding an outer circumferential edge of the workpiece; a fluid chamber provided in the top ring body and covered by a resilient membrane, with a fluid being supplied into the fluid chamber; and a plurality of pressing members provided between the resilient membrane and the workpiece for pressing the workpiece against the polishing surface through the resilient membrane by a pressure of the fluid in the fluid chamber.

According to another aspect of the present invention, there is also provided a polishing apparatus for polishing a workpiece, comprising: a polishing table having a polishing surface thereon; and a workpiece carrier for holding the workpiece to be polishing and pressing the workpiece against the polishing surface. The workpiece carrier comprises: a top ring body for holding the workpiece; a retainer ring for holding an outer circumferential edge of the workpiece; a fluid chamber provided in the top ring body and covered by a resilient membrane, with a fluid being supplied into the fluid chamber; and a plurality of pressing members provided between the resilient membrane and the workpiece for pressing the workpiece against the polishing surface through the resilient membrane by a pressure of the fluid in the fluid chamber.

With the above arrangement, the fluid in the fluid chamber applies a pressing force to the pressing members, and the pressing members press the workpiece against the polishing surface on the polishing table through the resilient membrane. Since the pressing members impose a pressure in a continuous and uniform pressure distribution, the polishing pressure is uniformly applied to the entire surface of the workpiece for thereby uniformly polishing the entire surface of the workpiece.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
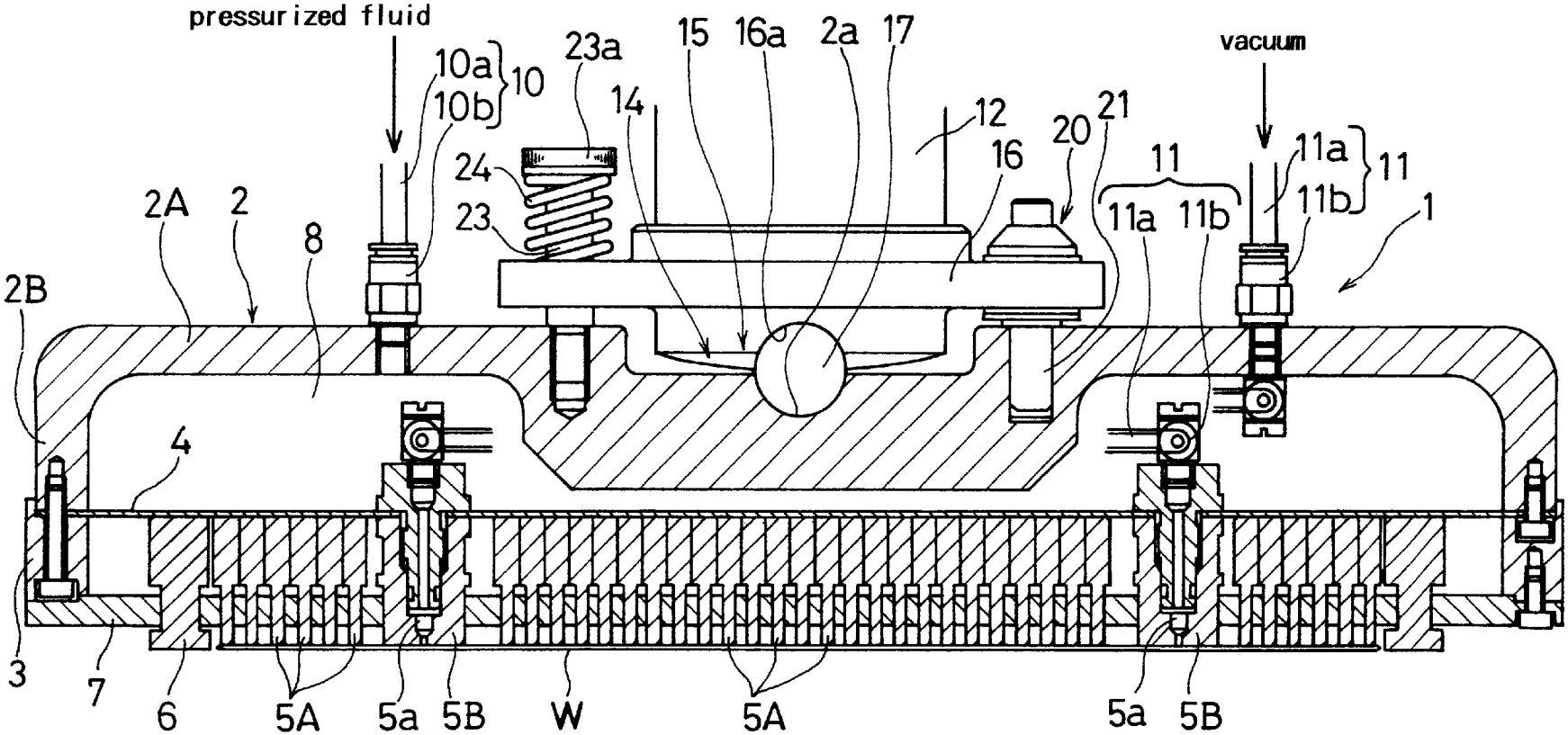
FIG. 1 is a vertical cross-sectional view of a workpiece carrier according to a first embodiment of the present invention.

A workpiece carrier and a polishing apparatus having such workpiece carrier according to embodiments of the present invention will be described below with reference to FIGS. 1 through 8. Like or corresponding parts are denoted by like or corresponding reference numerals throughout views.

Figure 2:
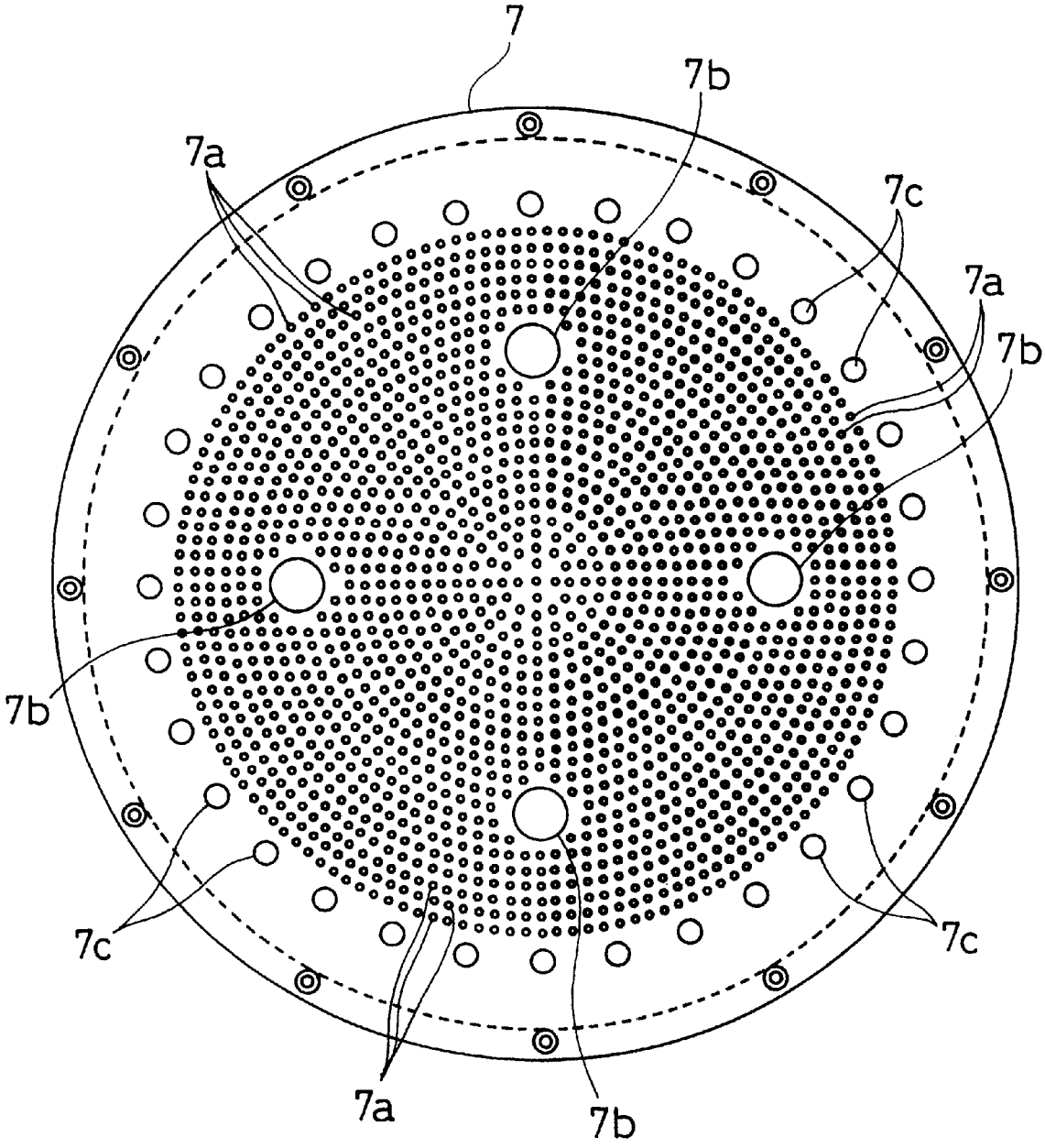
FIG. 2 is a plan view of a guide member of the workpiece carrier shown in FIG. 1.

FIG. 1 shows a workpiece carrier according to a first embodiment of the present invention, and FIG. 2 shows a guide member shown in FIG. 1. The workpiece carrier is used for holding a substrate such as a semiconductor wafer which is a workpiece to be polished, and pressing the substrate against a polishing surface on a polishing table.

As shown in FIGS. 1 and 2, a top ring 1 constitutes a workpiece carrier according to a first embodiment of the present invention. The top ring 1 comprises a hollow top ring body 2 with a lower open end, an annular member 3 fixed to a lower circumferential edge of the lower open end of the top ring body 2, and a resilient membrane 4 clamped between the lower circumferential edge of the top ring body 2 and the annular member 3. The top ring 1 further comprises a number of small-diameter pressing pins 5A fixed to the resilient membrane 4, four large-diameter pressing pins 5B fixed to the resilient membrane 4 for attracting a semiconductor wafer W, an annular retainer ring 6 fixed to the resilient membrane 4, and a disk-shaped guide member 7 fixed to the lower end of the annular member 3 for guiding the pressing pins 5A, 5B and the retainer ring 6 for vertical movement. The pressing pins 5A and the retainer ring 6 may not be fixed to the resilient membrane 4, but may be freely movable with respect to the resilient membrane 4.

The top ring body 2 and the resilient membrane 4 jointly define a hermetically sealed fluid chamber 8 therein. The resilient membrane 4 is made of an elastic material in the form of a rubber sheet such as polyurethane rubber or silicone rubber. The fluid chamber 8 is supplied with a pressurized fluid such as a pressurized air via a fluid passage 10 comprising a tube 10*a* and a connector 10*b*. The pressure of the pressurized fluid that is supplied to the fluid chamber 8 can be varied by a regulator or the like. Each of the pressing pins 5B has a communication hole 5*a* defined therein which is open at its lower end. The communication hole 5*a* is connected to a vacuum source (not shown) via a vacuum passage 11 comprising a tube 11*a* and a connector 11*b*.

As shown in FIG. 2, the guide member 7 has a number of first guide holes 7*a* with a small diameter defined therein and receiving the respective pressing pins 5A for guiding them for vertical movement, and four second guide holes 7*b* with a large diameter defined therein and receiving the respective pressing pins 5B for guiding them for vertical movement. The first guide holes 7*a* are evenly disposed over the guide member 7 such that the pressing pins 5A are held in contact with the entire surface of the semiconductor wafer evenly. Further, the guide member 7 has a plurality of retainer ring holes 7*c* arranged in a circular pattern of a predetermined diameter for guiding the retainer ring 6 for vertical movement. The retainer ring 6 has a continuous annular lower end, and a plurality of cylindrical rods extending upwardly from the continuous annular lower end and vertically movably fitted respectively in the retainer ring holes 7*c* of the guide member 7.

The top ring body 2 comprises a disk-shaped upper plate 2A, and an annular peripheral wall 2B extending downwardly from an outer circumferential edge of the upper plate 2A. A top ring drive shaft 12 disposed vertically above the upper plate 2A is operatively coupled to the top ring body 2 by a universal joint 14.

The universal joint 14 can transmit rotary motion from the top ring drive shaft 12 to the top ring body 2 while allowing the top ring drive shaft 12 and the top ring body 2 to be tilted relatively to each other. The universal joint 14 comprises a spherical bearing mechanism 15 for allowing the top ring drive shaft 12 and the top ring body 2 to be tilted relatively to each other, and a rotary motion transmitting mechanism 20 for transmitting rotary motion from the top ring drive shaft 12 to the top ring body 2. The spherical bearing mechanism 15 comprises a hemispherical recess 16*a* defined centrally in a lower surface of a drive flange 16 fixed to the lower end of the top ring drive shaft 12, a hemispherical recess 2*a* defined centrally in an upper surface of the upper plate 2A, and a ball bearing 17 made of a highly hard material such as ceramic and received in the hemispherical recesses 16*a*, 2*a*.

The rotary motion transmitting mechanism 20 comprises drive pins (not shown) fixed to the drive flange 16 and driven pins 21 fixed to the upper plate 2A. The drive pin and the driven pin 21 engage each other while being relatively movable in the vertical direction. Therefore, the drive pin and the driven pin 21 are held in engagement with each other through a point contact that is shiftable because the drive pin and the driven pin 21 move with respect to each other in the vertical direction. Therefore the drive pin and the driven pin 21 are capable of reliably transmitting the torque from the top ring drive shaft 12 to the top ring body 2. A plurality of bolts 23 is threaded in the upper plate 2A of the top ring body 2 along a circular pattern of a predetermined diameter. Compression coil springs 24 are disposed around the respective bolts 23 between heads 23*a* of the bolts 23 and the drive flange 16. The compression coil springs 24 serve to support the top ring 1 in a substantially horizontal plane when the top ring drive shaft 12 is lifted.

Operation of the top ring 1 having the above structure will be described below.

The top ring 1 is placed in its entirety in a position to which the semiconductor wafer W is delivered. The communication holes 5*a* in the pressing pins 5B are connected to the vacuum source via the vacuum passage 11 to attract the semiconductor wafer W to the lower surfaces of the pressing pins 5B under vacuum. Then, the top ring 1 is moved to a position over a turntable (not shown) having a polishing surface comprising a polishing cloth mounted thereon, and then lowered to press the semiconductor wafer W against the polishing surface. At this time, a polishing liquid is supplied onto the polishing surface, and the top ring 1 and the turntable are rotated about their respective axes, and the polishing surface on the turntable is brought into sliding contact with the semiconductor wafer W for thereby polishing the semiconductor wafer W. The semiconductor wafer W has its outer circumferential edge held in position by the retainer ring 6 for protection against accidental removal from the top ring 1.

The semiconductor wafer W can be pressed against the polishing surface in two manners. According to the first manner, the pressurized fluid having a given pressure is supplied to the fluid chamber 8, and an air cylinder (not shown) connected to the top ring drive shaft 12 is operated to press the entire top ring 1 against the polishing surface on the turntable under a predetermined pressure. In this manner, the polishing pressure applied to the semiconductor wafer W is adjusted to a desired value by regulating the air pressure supplied to the air cylinder without changing the pressure of the fluid supplied to the fluid chamber 8.

According to the second manner, the air cylinder connected to the top ring drive shaft 12 is operated to displace the top ring 1 toward the turntable to bring the semiconductor wafer W closely to the polishing surface, and then the pressurized fluid is supplied to the fluid chamber 8 to press the semiconductor wafer W against the polishing surface. In this manner, the polishing pressure applied to the semiconductor wafer W is adjusted to a desired value by regulating the pressure of the pressurized fluid supplied to the fluid chamber 8 without changing the air pressure supplied to the air cylinder.

According to either the first manner or the second manner, the polishing pressure applied to the semiconductor wafer W is exerted by the pressing pins 5A, 5B that are fixed to the resilient membrane 4 and held in contact with the upper surface of the semiconductor wafer W. The pressing pins 5A, 5B serve as pressing members for applying a pressing force (pressure per unit area, e.g. Pa) to the semiconductor wafer W. Since the pressing force from the pressurized fluid in the fluid chamber 8 is applied as a uniformly distributed load to the semiconductor wafer W by the pressing pins 5A, 5B, the polishing pressure is uniformly applied to the entire surface of the semiconductor wafer W from the central area to the outer circumferential edged thereon, irrespective of variation in thickness of the semiconductor wafer. The same pressure as the polishing pressure applied to the semiconductor wafer W is transmitted by the resilient membrane 4 to the retainer ring 6. Therefore, the area of the polishing surface, comprising a polishing cloth, located around the semiconductor wafer W is pressed by the same pressure as the polishing pressure applied to the semiconductor wafer W. As a result, there is developed a continuous and uniform pressure distribution from the central portion to the outer circumferential edge of the semiconductor wafer W and also to the outer circumferential edge of the retainer ring 6 that is positioned radially outwardly of the semiconductor wafer W. Consequently, the outer circumferential portion of the semiconductor wafer W is prevented from being polished excessively or insufficiently.

Figure 3:
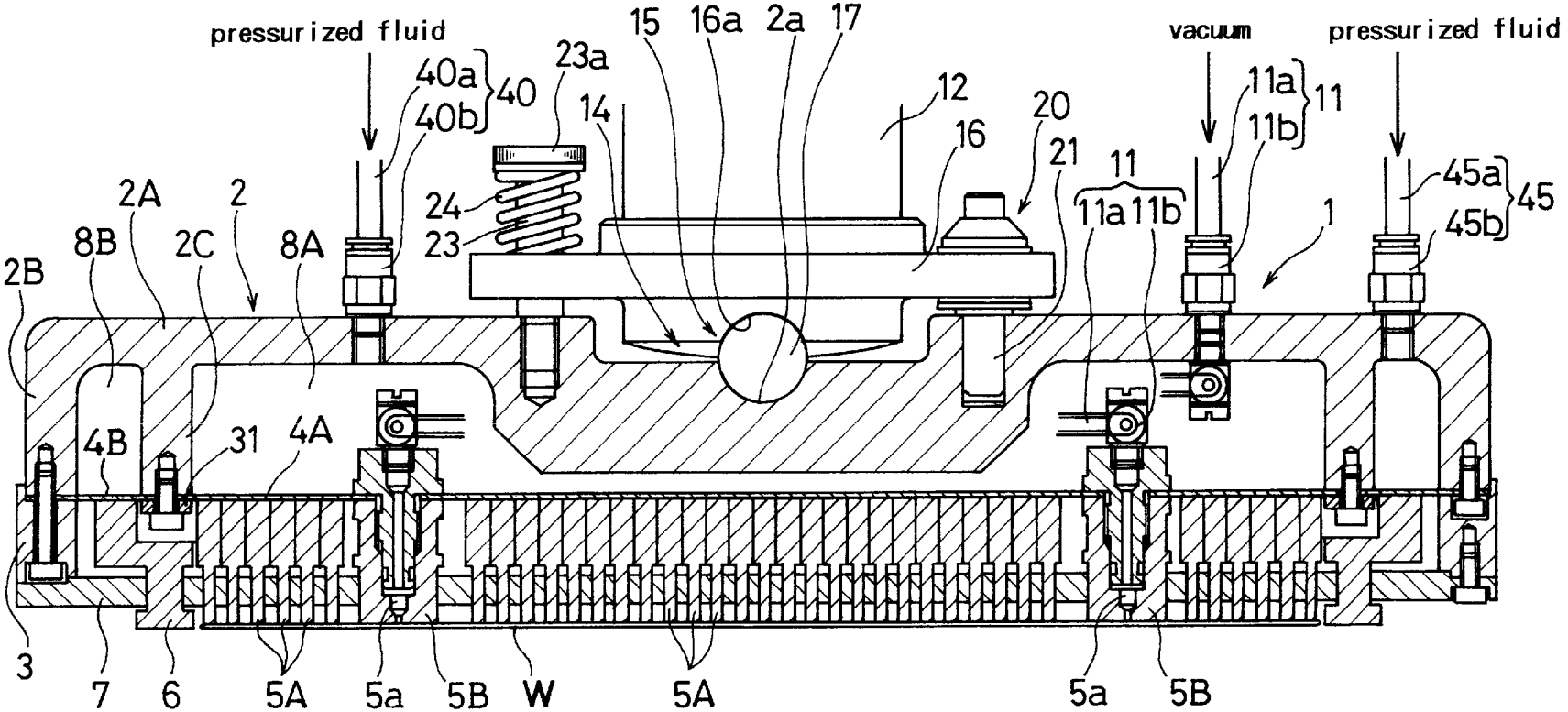
FIG. 3 is a vertical cross-sectional view of a workpiece carrier according to a second embodiment of the present invention.

FIG. 3 shows a workpiece carrier according to a second embodiment of the present invention. According to the second embodiment, the hollow top ring body 2 has its inner space divided into a central circular space and an outer circumferential annular space radially outward of the central circular space by an annular partition wall 2C. A circular resilient membrane 4A and an annular resilient membrane 4B radially outward of the circular resilient membrane 4A are fixed to the lower end of the top ring body 2. The circular resilient membrane 4A has an outer circumferential edge secured to the partition wall 2C by a holder plate 31 comprising an annular thin plate, and the resilient membrane 4B has an inner circumferential edge secured to the partition wall 2C by the holder plate 31. The resilient membranes 4A, 4B may be constructed as a single unitary resilient membrane. In such a case also, the holder plate 31 may be used for partitioning an inner chamber and an outer chamber. The resilient membrane 4B has an outer circumferential edge fixed to the annular peripheral wall 2B of the top ring body 2 by the annular member 3.

The top ring body 2 and the circular resilient membrane 4A jointly define a hermetically sealed circular fluid chamber 8A therein, and the top ring body 2 and the annular resilient membrane 4B jointly define a hermetically sealed annular fluid chamber 8B therein. The fluid chamber 8A is supplied with a pressurized fluid such as a pressurized air via a fluid passage 40 comprising a tube 40*a* and a connector 40*b*. The fluid chamber 8B is supplied with a pressurized fluid such as a pressurized air via a fluid passage 45 comprising a tube 45*a* and a connector 45*b*. The pressure of the pressurized fluid that is supplied to the fluid chamber 8A and the pressure of the pressurized fluid that is supplied to the fluid chamber 8B can be varied independently of each other by respective regulators or the like. Each of the pressing pins 5B has a communication hole 5*a* defined therein which is open at its lower end. The communication hole 5*a* is connected to a vacuum source (not shown) via a vacuum passage 11 comprising a tube 11*a* and a connector 11*b*.

A number of pressing pins 5A and the four pressing pins 5B are fixed to the resilient membrane 4A. The retainer ring 6 is fixed to the resilient membrane 4B. Structural details of the retainer ring 6 and the guide member 7, and other structural details are identical to those of the workpiece carrier according to the first embodiment shown in FIGS. 1 and 2. The pressing pins 5A and the retainer ring 6 may not be fixed to the resilient membranes 4A and 4B, but may be freely movable with respect to the resilient membranes 4A and 4B.

Operation of the top ring 1 of the workpiece carrier according to the second embodiment will be described below.

The top ring 1 attracts the semiconductor wafer W under vacuum in the same manner as with the first embodiment.

The polishing pressure applied to the semiconductor wafer W and the pressing force applied to the retainer ring 6 can be controlled independently of each other. Specifically, the pressure of the fluid supplied to the fluid chamber 8B is adjusted depending on the pressure of the fluid supplied to the fluid chamber 8A for adjusting the polishing pressure applied to the semiconductor wafer W and the pressing force applied to the retainer ring 6 to an optimum relationship with respect to each other. As a result, there is developed a continuous and uniform pressure distribution from the central area to the outer circumferential edge of the semiconductor wafer W and further to the outer circumferential edge of the retainer ring 6 that is positioned radially outwardly of the semiconductor wafer W. Consequently, the outer circumferential portion of the semiconductor wafer W is prevented from being polished excessively or insufficiently. If the outer circumferential portion of the semiconductor wafer W needs to be polished to a larger or smaller extent than the radially inner area of the semiconductor wafer W, then the pressing force applied to the retainer ring 6 is increased or decreased based on the polishing pressure applied to the semiconductor wafer W. Accordingly, the amount of material removed from the outer circumferential portion of the semiconductor wafer W can be intentionally increased or decreased.

Figure 4:
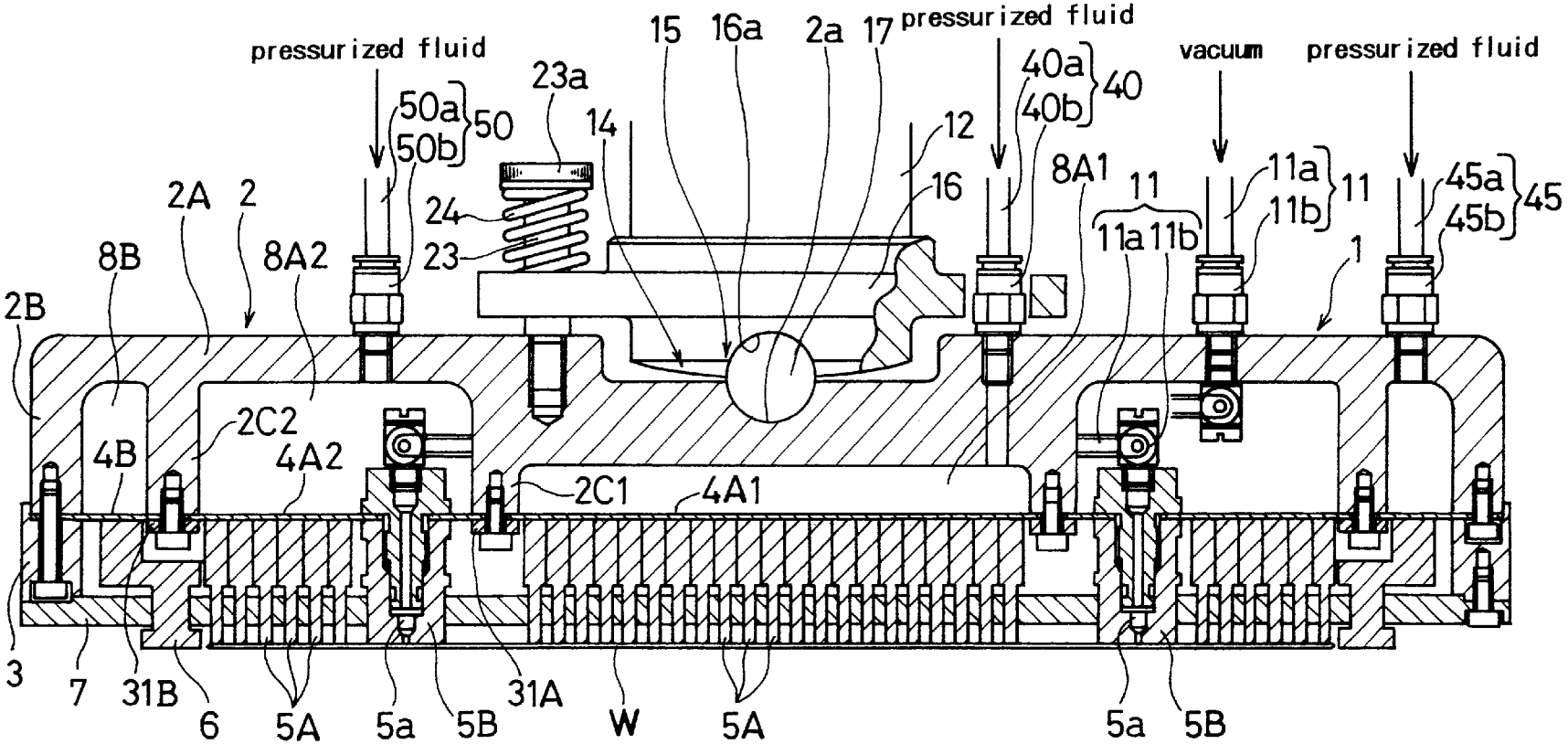
FIG. 4 is a vertical cross-sectional view of a workpiece carrier according to a third embodiment of the present invention.

FIG. 4 shows a workpiece carrier according to a third embodiment of the present invention. According to the third embodiment, the hollow top ring body 2 has its inner space divided into a central circular space, an intermediate annular space radially outward of the central circular space, and an outer circumferential annular space radially outward of the intermediate annular space by a first annular partition wall 2C1 and a second annular partition wall 2C2. A circular resilient membrane 4A1, an annular resilient membrane 4A2 radially outward of the circular resilient membrane 4A1, and an annular resilient membrane 4B radially outward of the annular resilient membrane 4A2 are fixed to the lower end of the top ring body 2. The resilient membrane 4A1 has an outer circumferential edge secured to the first annular partition wall 2C1 by a holder plate 31A comprising an annular thin plate, and the resilient membrane 4A2 has an inner circumferential edge secured to the partition wall 2C1 by the holder plate 31A. The resilient membrane 4A2 has an outer circumferential edge secured to the second annular partition wall 2C2 by a holder plate 31B comprising an annular thin plate, and the resilient membrane 4B has an inner circumferential edge secured to the second annular partition wall 2C2 by the holder plate 31B. The resilient membranes 4A1, 4A2 and 4B may be constructed as a single unitary resilient membrane. The resilient membrane 4B has an outer circumferential edge fixed to the annular peripheral wall 2B of the top ring body 2 by the annular member 3.

The top ring body 2 and the circular resilient membrane 4A1 jointly define a hermetically sealed circular first fluid chamber 8A1, and the top ring body 2 and the annular resilient membrane 4A2 jointly define a hermetically sealed annular second fluid chamber 8A2. The top ring body 2 and the resilient membrane 4B jointly define a hermetically sealed annular fluid chamber 8B. The first fluid chamber 8A1 is supplied with a pressurized fluid such as a compressed air via a fluid passage 40 comprising a tube 40*a* and a connector 40*b*. The second fluid chamber 8A2 is supplied with a pressurized fluid such as a compressed air via a fluid passage 50 comprising a tube 50*a* and a connector 50*b*. The fluid chamber 8B is supplied with a pressurized fluid such as a compressed air via a fluid passage 45 comprising a tube 45*a* and a connector 45*b*. The pressure of the fluid that is supplied to the first fluid chamber 8A1, the pressure of the fluid that is supplied to the second fluid chamber 8A2, and the pressure of the fluid that is supplied to the fluid chamber 8B can be varied independently of each other by respective regulators or the like. Each of the pressing pins 5B has a communication hole 5*a* defined therein which is open at its lower end. The communication hole 5*a* is connected to a vacuum source (not shown) via a vacuum passage 11 comprising a tube 11*a* and a connector 11*b*.

Some of the pressing pins 5A are fixed to the circular resilient membrane 4A1, and the remaining pressing pins 5A and the four pressing pins 5B are fixed to the annular resilient membrane 4A2. The retainer ring 6 is fixed to the resilient membrane 4B. Structural details of the retainer ring 6 and the guide member 7, and other structural details are identical to those of the workpiece carrier according to the first embodiment shown in FIGS. 1 and 2. The pressing pins 5A and the retainer ring 6 may not be fixed to the resilient membranes 4A1, 4A2 and 4B, but may be freely movable with respect to the resilient membranes 4A1, 4A2 and 4B.

Operation of the top ring 1 of the workpiece carrier according to the third embodiment will be described below.

The top ring 1 attracts the semiconductor wafer W under vacuum in the same manner as with the first embodiment. The polishing pressure applied to a central circular area of the semiconductor wafer W, the polishing pressure applied to a radially outer annular area of the semiconductor wafer W, and the pressing force applied to the retainer ring 6 can be controlled independently of each other. Specifically, the pressure of the fluid supplied to the first fluid chamber 8A1 and the pressure of the fluid supplied to the second fluid chamber 8A2 are adjusted to respective desired values to change the polishing pressures acting on the central circular area and the radially outer annular area of the semiconductor wafer W, respectively. Therefore, if the radially outer annular area of the semiconductor wafer W tends to be polished more than the central circular area of the semiconductor wafer W, then the polishing pressure on the radially outer annular area of the semiconductor wafer W is made higher than the polishing pressure on the central circular area of the semiconductor wafer W to compensate for the shortage of polishing on the radially outer annular area of the semiconductor wafer W, thereby polishing the entire surface of the semiconductor wafer W uniformly.

The pressure of the fluid supplied to the fluid chamber 8B is adjusted depending on the pressure of the fluid supplied to the fluid chamber 8A1 and/or the pressure of the fluid supplied to the fluid chamber 8A2 for adjusting the polishing pressure applied to the semiconductor wafer W and the pressing force applied to the retainer ring 6 to an optimum relationship with respect to each other. As a result, there is developed a continuous and uniform pressure distribution from the central area to the outer circumferential edge of the semiconductor wafer W and further to the outer circumferential edge of the retainer ring 6 that is positioned radially outwardly of the semiconductor wafer W. Consequently, the outer circumferential portion of the semiconductor wafer W is prevented from being polished excessively or insufficiently. If the outer circumferential portion of the semiconductor wafer W needs to be polished to a larger or smaller extent than the radially inner area of the semiconductor wafer W, then the pressing force applied to the retainer ring 6 is increased or decreased based on the polishing pressure applied to the semiconductor wafer W. Accordingly, the amount of material removed from the outer circumferential portion of the semiconductor wafer W can be intentionally increased or decreased.

Figure 5:
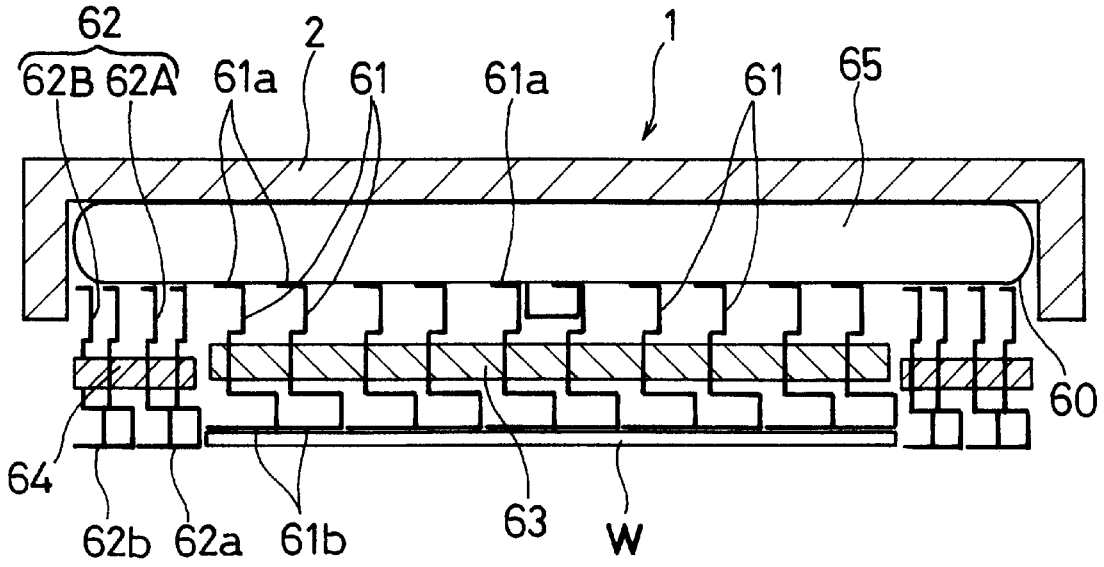
FIG. 5 is a schematic vertical cross-sectional view of a workpiece carrier according to a fourth embodiment of the present invention.
Figure 6:
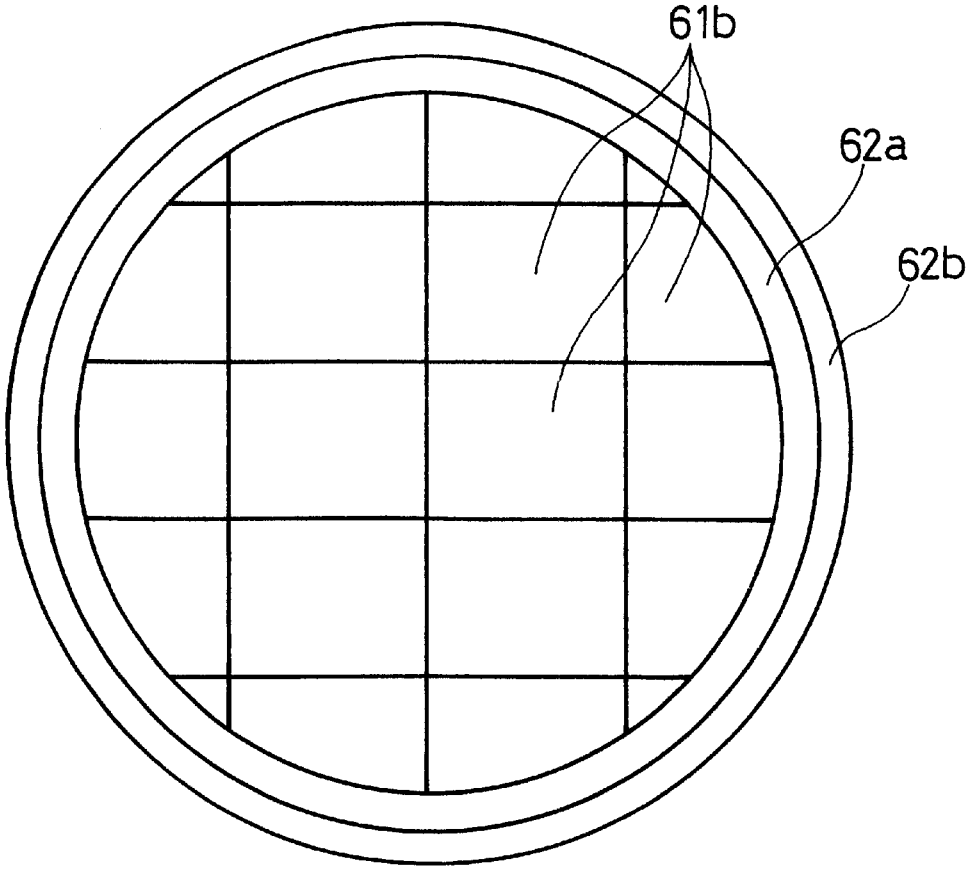
FIG. 6 is a bottom view of the workpiece carrier shown in FIG. 5.

FIGS. 5 and 6 show a workpiece carrier according to a fourth embodiment of the present invention.

As shown in FIG. 5, a top ring 1 constitutes the workpiece carrier according to the fourth embodiment. The top ring 1 comprises a hollow top ring body 2 with a lower open end, a fluid pressure bag 60 housed in the hollow top ring body 2 and supplied with a pressurized fluid such as a pressurized air, and a plurality of pressing pins 61 held in contact with the fluid pressure bag 60. The top ring 1 further comprises a retainer ring 62 held in contact with the fluid pressure bag 60, a disk-shaped guide member 63 for guiding the pressing pins 61 for vertical movement, and a ring-shaped guide member 64 for guiding the retainer ring 62 for vertical movement.

The fluid pressure bag 60 comprises a bag-shaped resilient membrane and defines a hermetically sealed fluid chamber 65 therein. The fluid chamber 65 is supplied with a pressurized fluid such as a pressurized air via a fluid passage (not shown) comprising a tube and a connector. The pressing pins 61 include respective bag-contact ends 61*a* having a predetermined area held in contact with the fluid pressure bag 60, and respective wafer-contact ends 61*b* having a predetermined area held in contact with the semiconductor wafer W. The retainer ring 62 comprises a first retainer ring 62A disposed in a radially inner annular area and a second retainer ring 62B disposed in a radially outer annular area. The ratio of the predetermined area of the bag-contact end 61*a* to the predetermined area of the wafer-contact end 61*b* may be changed from pin to pin for positionally controlling the polishing pressure applied to the semiconductor wafer W.

FIG. 6 shows lower ends of the wafer-contact ends 61*b* of the pressing pins 61 and the retainer ring 62. As shown in FIG. 6, each of the wafer-contact ends 61*b* is of a substantially rectangular shape. The pressing pins 61 are arranged such that the wafer-contact ends 61*b* cover substantially the entire surface of the semiconductor wafer W. The first and second retainer rings 62A, 62B have respective annular lower ends 62*a*, 62*b* each having a predetermined area and providing a surface for contacting the polishing surface, such as a polishing cloth, on the turntable. A top ring drive shaft (not shown in FIG. 5), which is similar to the top ring drive shaft 12 shown in FIG. 1, is connected to the top ring body 2.

The workpiece carrier according to the fourth embodiment operates as follows: The top ring 1 is positioned above the turntable with the polishing surface comprising a polishing cloth or the like, and then lowered to press the semiconductor wafer W against the polishing surface. At this time, a polishing liquid is supplied onto the polishing surface, and the top ring 1 and the turntable are rotated about their respective axes, and the polishing surface on the turntable is brought into sliding contact with the semiconductor wafer W for thereby polishing the semiconductor wafer W. The semiconductor wafer W has its outer circumferential edge held in position by the retainer ring 62 for protection against accidental removal from the top ring 1.

The semiconductor wafer W can be pressed against the polishing surface in two manners. According to the first manner, the pressurized fluid having a given pressure is supplied to the fluid chamber 65 in the fluid pressure bag 60, and an air cylinder (not shown) connected to the top ring drive shaft (not shown) is operated to press the entire top ring 1 against the polishing surface on the turntable under a predetermined pressure. In this manner, the polishing pressure applied to the semiconductor wafer W is adjusted to a desired value by regulating the air pressure supplied to the air cylinder without changing the pressure of the pressurized fluid supplied to the fluid chamber 65.

According to the second manner, the air cylinder connected to the top ring drive shaft is operated to displace the top ring 1 toward the turntable to bring the semiconductor wafer W closely to the polishing surface, and then the pressurized fluid is supplied to the fluid chamber 65 to press the semiconductor wafer W against the polishing surface. In this manner, the polishing pressure applied to the semiconductor wafer W is adjusted to a desired value by regulating the pressure of the pressurized fluid supplied to the fluid chamber 65 without changing the air pressure supplied to the air cylinder.

According to either the first manner or the second manner, the polishing pressure applied to the semiconductor wafer W is exerted by the pressing pins 61 that are held in contact with the fluid pressure bag 60 and the upper surface of the semiconductor wafer W. Since the 15 pressing pins 61 pressed by the fluid in the fluid pressure bag 60 apply a uniformly distributed load to the semiconductor wafer W, the polishing pressure is uniformly applied to the entire surface of the semiconductor wafer W from the central area to the outer circumferential edge thereof, irrespective of variation in thickness of the semiconductor wafer. Therefore, the entire surface of the semiconductor wafer W can be polished uniformly. The same pressing force as the polishing pressure applied to the semiconductor wafer W is transmitted by the fluid pressure bag 60 to the retainer ring 62. Therefore, the portion of the polishing surface located around the semiconductor water W is pressed by the same pressure as the polishing pressure applied to the semiconductor wafer W. As a result, there is developed a continuous and uniform pressure distribution from the central area to the outer circumferential edge of the semiconductor wafer W and also to the outer circumferential edge of the retainer ring 62 that is positioned radially outwardly of the semiconductor wafer W. Consequently, the outer circumferential portion of the semiconductor wafer W is prevented from being polished excessively or insufficiently.

The fluid pressure bag may comprise a plurality of radially divided bags including a circular bag and at least one annular bag radially outwardly of the circular bag. The workpiece carrier having divided pressure bags can offer the same advantages as those of the workpiece carriers according to the second and third embodiments shown in FIGS. 3 and 4.

Figure 7B:
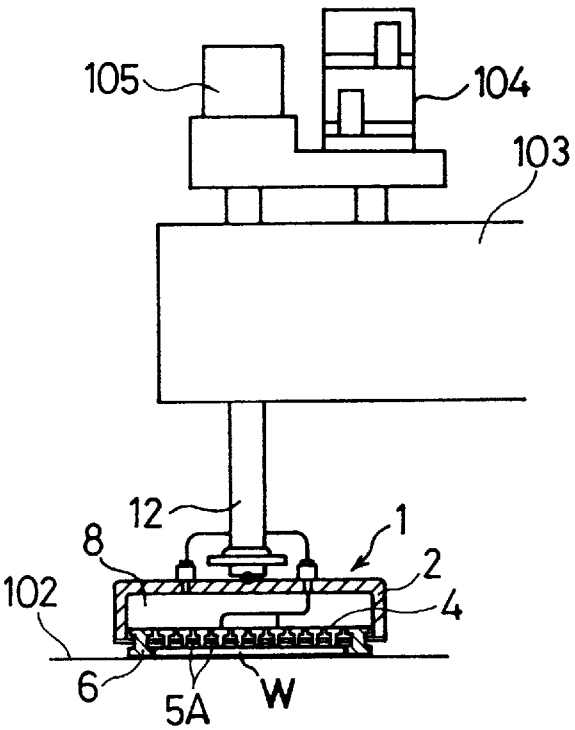
FIGS. 7A and 7B are fragmentary sectional front elevational views of a polishing apparatus which incorporates the workpiece carrier shown in FIGS. 1 and 2.
Figure 7A:
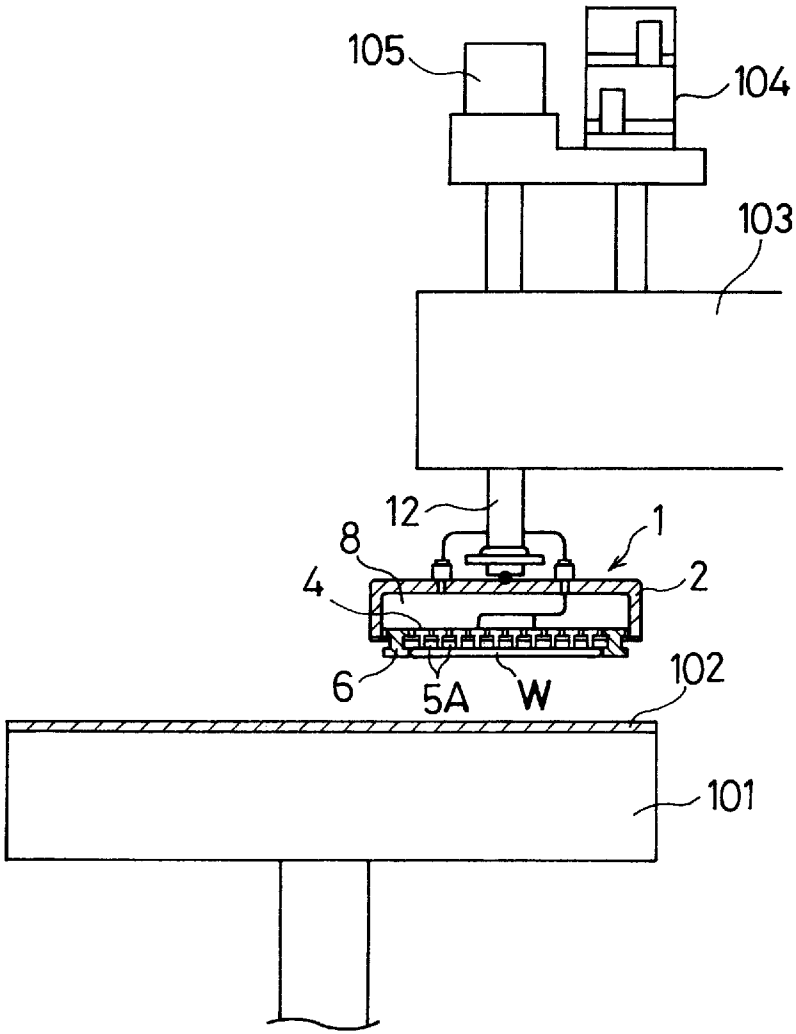

FIGS. 7A and 7B show, in fragmentary sectional front elevational views, a polishing apparatus which incorporates the workpiece carrier shown in FIGS. 1 and 2.

As shown in FIGS. 7A and 7B, the polishing apparatus comprises a turntable 101 with a polishing cloth 102 mounted on its upper surface, and a top ring 1 for pressing a semiconductor wafer W against the polishing cloth 102. The top ring 1 has a fluid pressure chamber 8 defined therein. The top ring 1 is coupled to the lower end of a top ring drive shaft 12 which is operatively connected to a top ring air cylinder 104 fixedly mounted on a top ring head 103 and also operatively connected to a motor 105 for rotating the top ring drive shaft 12 about its own axis.

As shown in FIG. 7A, while the fluid pressure chamber 8 is supplied with a pressurized fluid having a given pressure, the top ring 1 attracts a semiconductor wafer W under a negative pressure, i.e., a pressure lower than the atmospheric pressure, acting through the pressing pins 5B, and transfers the semiconductor wafer W to a position above the turntable 101. Then, as shown in FIG. 7B, the top ring air cylinder 104 coupled to the top ring drive shaft 12 is actuated to press the top ring 1 in its entirety against the polishing cloth 102 on the turntable 101 under a predetermined pressing force. The polishing pressure applied to the semiconductor wafer W is adjusted to a desired value by regulating the pressure supplied to the air cylinder 104 without changing the pressure of the fluid supplied to the fluid chamber 8.

Figures 8A, 8B, 8C:
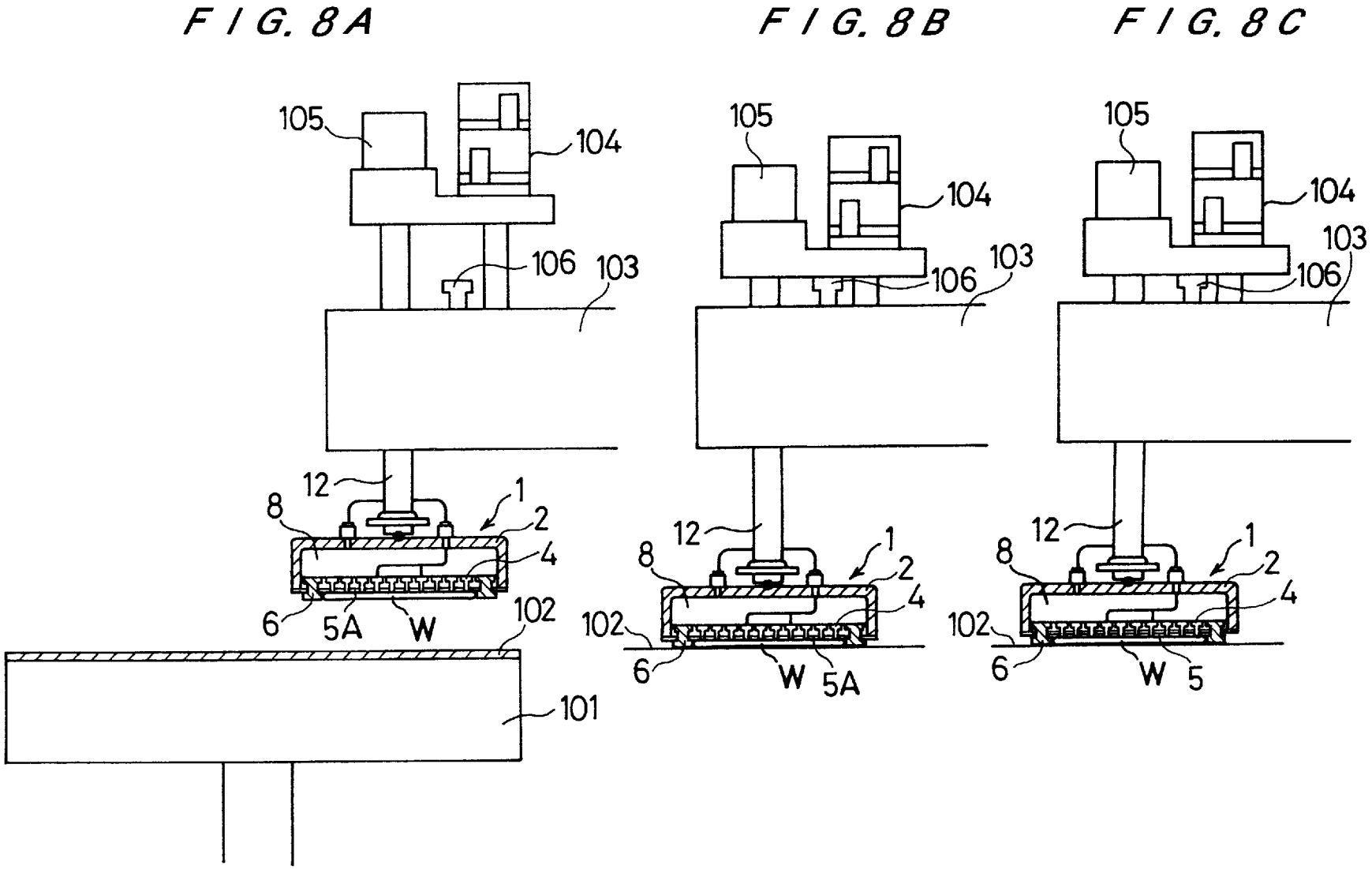
FIGS. 8A, 8B, and 8C are fragmentary sectional front elevational views of another polishing apparatus which incorporates the workpiece carrier shown in FIGS. 1 and 2.

FIGS. 8A, 8B and 8C show, in fragmentary sectional front elevational views, another polishing apparatus which incorporates the workpiece carrier shown in FIGS. 1 and 2.

The polishing apparatus shown in FIGS. 8A, 8B and 8C is basically identical to the polishing apparatus shown in FIGS. 7A and 7B, but differs therefrom in that a stopper 106 is mounted on the upper surface of the top ring head 103.

As shown in FIG. 8A, the top ring 1 attracts a semiconductor wafer W under a negative pressure, i.e., a pressure lower than the atmospheric pressure, acting through the pressing pins 5B, and transfers the semiconductor wafer W to a position over the turntable 101. Then, as shown in FIG. 8B, the top ring air cylinder 104 coupled to the top ring drive shaft 12 is actuated to lower the top ring 1 until the downward movement of the top ring 1 is limited by the stopper 106, whereupon the top ring 1 is stopped just before the semiconductor wafer W contacts the polishing cloth 102. The load or pressure produced by the top ring air cylinder 104 is equal to or larger than the load or pressure that is applied to the semiconductor wafer W and the retainer ring 6 when the semiconductor wafer W is polished.

Next, the fluid pressure chamber 8 is supplied with a pressurized fluid having a given pressure for thereby expanding the resilient membrane 4 downwardly to lower the pressing pins 5A, 5B and the retainer ring 6 and to press the semiconductor wafer W against the polishing cloth 102. The semiconductor wafer W now starts being polished under the given polishing pressure, while the turntable 101 and the top ring 1 are being rotated about their own axes. The polishing pressure applied to the semiconductor wafer W is adjusted to a desired value by regulating the pressure of the fluid supplied to the fluid chamber 8.

In the present invention, the polishing surface on the turntable can be formed by the polishing cloth (polishing pad) or a fixed-abrasive. Examples of commercially available polishing cloths are SUBA 800, IC-1000, IC-1000/SUBA 400 (double layered cloth) manufactured by Rodel Products Corporation, and Surfin xxx-5 and Surfin 000 manufactured by Fujimi Inc. The polishing cloth sold under the trade name SUBA 800, Surfin xxx-5, and Surfin 000 is made of non-woven fabric composed of fibers bound together by urethane resin, and the polishing cloth sold under the trade name IC-1000 is made of hard polyurethane (single layered) which is porous and has minute recesses or micropores in its surface.

The fixed-abrasive is formed into a plate shape by fixing abrasive particles in a binder. The polishing operation is performed by abrasive particles self-generated on the surface of the fixed-abrasive. The fixed-abrasive is composed of abrasive particles, binder and micropores. For example, the abrasive particles used in the fixed-abrasive are cerium oxide ($CeO_2$) having an average particle size of not more than 0.5 $\mu$m, and epoxy resin is used as the binder. The fixed-abrasive constitutes a hard polishing surface. The fixed-abrasive includes not only a plate-type fixed-abrasive but also a double layered fixed-abrasive pad comprising a fixed-abrasive and a polishing pad having elasticity to which the fixed-abrasive is adhered. Another hard polishing surface can be provided by the above mentioned IC-1000.

The polishing table to be employed in the present invention is not limited to the turntable of a type which rotates around the central axis thereof, and includes a table of scroll type in which any point on the table makes a circulative translational motion.

According to the present invention, the fluid in he fluid chamber applies a pressing force to the pressing members, and the pressing members press the workpiece against the polishing surface on the polishing table. Since the pressing members impose a pressure in a continuous and uniform pressure distribution, the polishing pressure is uniformly applied to the entire surface of the workpiece for thereby uniformly polishing the entire surface of the workpiece.

Although certain preferred embodiments of the present invention have been shown and described in detail, it should be understood that various changes and modifications may be made therein without departing from the scope of the appended claims.

What is claimed is:

1. A workpiece carrier for holding a workpiece to be polished and pressing the workpiece against a polishing surface on a polishing table, comprising:

a top ring body for holding the workpiece;

a retainer ring for holding an outer circumferential edge of the workpiece;

a fluid chamber provided in said top ring body and covered by a resilient membrane, said fluid chamber being constructed and arranged to receive a fluid; and pressing members provided between said resilient membrane and the workpiece, when the workpiece is held by said top ring body, for pressing the workpiece against the polishing surface through said resilient membrane via a pressure of the fluid in said fluid chamber, wherein at least one of said pressing members has a communication hole for attracting the workpiece.

2. The workpiece carrier according to claim 1, wherein said retainer ring is constructed and arranged to be pressed against the polishing surface through said resilient membrane via the pressure of the fluid in said fluid chamber.

3. The workpiece carrier according to claim 1, wherein said fluid chamber is divided into plural chambers including at least one chamber for pressing of the workpiece against the polishing surface by said pressing members via the pressure of the fluid in said at least one chamber.

4. The workpiece carrier according to claim 1, wherein said fluid chamber is radially divided into plural chambers including a radially inner chamber for pressing of a radially inner area of the workpiece against the polishing surface by said pressing members via the pressure of the fluid in said radially inner chamber, and a radially outer chamber for pressing of a radially outer area of the workpiece against the polishing surface by said pressing members via the pressure of the fluid in said radially outer chamber.

5. The workpiece carrier according to claim 3, wherein said plural chambers include at least one additional chamber for pressing of said retainer ring against the polishing surface via pressure of the fluid in said at least one additional chamber.

6. The workpiece carrier according to claim 1, wherein said fluid chamber is constructed and arranged to receive the fluid at different pressures such that a polishing pressure to be applied to the workpiece can be adjusted by regulating the pressure of the fluid received by said fluid chamber.

7. The workpiece carrier according to claim 1, wherein said top ring body is constructed and arranged to be pressed toward the polishing surface such that a polishing pressure to be applied to the workpiece can be adjusted by regulating a force for pressing said top ring body toward the polishing surface, while maintaining constant the pressure of the fluid received within said fluid chamber.

8. The workpiece carrier according to claim 1, further comprising a guide member for guiding said pressing members.

9. The workpiece carrier according to claim 1, wherein each of said pressing members has a desired ratio of a predetermined area contacting said resilient membrane to a predetermined area contacting the workpiece, when the workpiece is held by said top ring body, for positionally controlling the polishing pressure to be applied to the workpiece.

10. A polishing apparatus for polishing a workpiece, comprising:

a polishing table having a polishing surface thereon; and a workpiece carrier for holding the workpiece to be polished and pressing the workpiece against said polishing surface;

said workpiece carrier including (i) a top ring body for holding the workpiece, (ii) a retainer ring for holding an outer circumferential edge of the workpiece, (iii) a fluid chamber provided in said top ring body and covered by a resilient membrane, said fluid chamber being constructed and arranged to receive a fluid, and (iv) pressing members provided between said resilient membrane and the workpiece, when the workpiece is held by said top ring body, for pressing the workpiece against said polishing surface through said resilient membrane via a pressure of the fluid in said fluid chamber, wherein at least one of said pressing members has a communication hole for attracting the workpiece.

11. The polishing apparatus according to claim 10, wherein said retainer ring is constructed and arranged to be pressed against said polishing surface through said resilient membrane via the pressure of the fluid in said fluid chamber.

12. The polishing apparatus according to claim 10, wherein said fluid chamber is divided into plural chambers including at least one chamber for pressing of the workpiece against said polishing surface by said pressing members via the pressure of said fluid in said at least one chamber.

13. The polishing apparatus according to claim 10, wherein said fluid chamber is radially divided into plural chambers including a radially inner chamber for pressing of a radially inner area of the workpiece against said polishing surface by said pressing members via the pressure of the fluid in said radially inner chamber, and a radially outer chamber for pressing of a radially outer area of the workpiece against said polishing surface by said pressing members via the pressure of the fluid in said radially outer chamber.

14. The polishing apparatus according to claim 12, wherein said plural chambers include at least one additional chamber for pressing of said retainer ring against said polishing surface via pressure of the fluid in said at least one additional chamber.

15. The polishing apparatus according to claim 10, wherein said fluid chamber is constructed and arranged to receive the fluid at different pressures such that a polishing pressure to be applied to the workpiece can be adjusted by regulating the pressure of the fluid received by said fluid chamber.

16. The polishing apparatus according to claim 10, wherein said top ring body is constructed and arranged to be pressed toward said polishing surface such that a polishing pressure to be applied to the workpiece can be adjusted by regulating a force for pressing said top ring body toward said polishing surface, while maintaining constant the pressure of the fluid received within said fluid chamber.

17. The polishing apparatus according to claim 10, wherein said workpiece carrier further includes a guide member for guiding said pressing members.

18. The polishing apparatus according to claim 10, wherein each of said pressing members has a desired ratio of a predetermined area contacting said resilient membrane to a predetermined area contacting the workpiece, when the workpiece is held by said top ring body, for positionally controlling the polishing pressure to be applied to the workpiece.

* * * * *